US009516436B2

(12) United States Patent
Nikles

(10) Patent No.: US 9,516,436 B2
(45) Date of Patent: Dec. 6, 2016

(54) BINAURAL HEARING INSTRUMENT AND EARPIECE

(71) Applicant: SIVANTOS PTE. LTD., Singapore (SG)

(72) Inventor: Peter Nikles, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 95 days.

(21) Appl. No.: 14/218,066

(22) Filed: Mar. 18, 2014

(65) Prior Publication Data

US 2014/0270191 A1 Sep. 18, 2014

(30) Foreign Application Priority Data

Mar. 18, 2013 (DE) ..... 10 2013 204 681

(51) Int. Cl.

| | |
|---|---|
| ***H04R 25/00*** | (2006.01) |
| ***H01Q 1/27*** | (2006.01) |
| *H04R 25/02* | (2006.01) |
| *H04R 1/10* | (2006.01) |

(52) U.S. Cl.

CPC ..... *H04R 25/65* (2013.01); *H01Q 1/273* (2013.01); *H04R 25/552* (2013.01); *H04R 25/554* (2013.01); *H04R 1/10* (2013.01); *H04R 25/02* (2013.01); *H04R 25/60* (2013.01); *H04R 2225/023* (2013.01); *H04R 2225/025* (2013.01); *H04R 2225/51* (2013.01)

(58) Field of Classification Search

None

See application file for complete search history.

(56) References Cited

U.S. PATENT DOCUMENTS

| | | | | |
|---|---|---|---|---|
| 7,443,991 | B2 | 10/2008 | Niederdränk et al. | |
| 2004/0247149 | A1* | 12/2004 | Sorensen | H04R 25/602 381/328 |
| 2008/0118094 | A1 | 5/2008 | Roth et al. | |
| 2010/0128905 | A1* | 5/2010 | Warren | H04R 1/1016 381/312 |
| 2012/0041298 | A1* | 2/2012 | Mersky | 600/410 |

FOREIGN PATENT DOCUMENTS

WO 2013135307 A1 9/2013

* cited by examiner

*Primary Examiner* — Andrew L Sniezek

(74) *Attorney, Agent, or Firm* — Laurence A. Greenberg; Werner H. Stemer; Ralph E. Locher

(57) ABSTRACT

A binaural hearing instrument and an earpiece for the binaural hearing instrument are enabled for broadband wireless data transmission to a further binaural hearing instrument. Wireless broadband binaural data transmission with high bandwidth and low resource requirement is afforded, while the devices can be manufactured easily and inexpensively. The hearing instrument has a housing, a signal processor, a receiver and an antenna for binaural data transmission. The housing can be worn at least partly in an auditory canal. A distal section houses the signal processor and the receiver. A proximal section adjacent to the eardrum and separated spatially from the proximal section houses the antenna. The antenna is disposed between the receiver and the sound outlet as far in the auditory canal as possible. The distance between the antennas of the two binaural hearing instruments is reduced compared with conventional positioning and the bit error rate is significantly improved.

4 Claims, 3 Drawing Sheets

BINAURAL HEARING INSTRUMENT AND EARPIECE

CROSS-REFERENCE TO RELATED APPLICATION

This application claims the priority, under 35 U.S.C. §119, of German patent application DE 10 2013 204 681.2, filed Mar. 18, 2013; the prior application is herewith incorporated by reference in its entirety.

BACKGROUND OF THE INVENTION

Field of the Invention

The invention relates to a binaural hearing instrument and to an earpiece for a binaural hearing instrument, which allows for a broadband wireless data transmission to a further binaural hearing instrument.

Hearing instruments can be embodied for instance as hearing aids. A hearing aid, or hearing device, is used to supply a hearing-impaired person with acoustic ambient signals. The signals are processed and amplified in order to compensate for or treat the respective hearing impairment. It consists, in principle, of one or a number of input transducers, a signal processing facility, an amplifier and an output transducer. The input transducer is generally a sound receiver, such as a microphone, and/or an electromagnetic receiver, such as an induction coil. The output transducer is usually implemented as an electro-acoustic converter, e.g. a miniature loudspeaker, or as an electromechanical converter, e.g. a bone conduction earpiece. It is also referred to as an earpiece or receiver. The output transducer generates output signals, which are routed to the ear of the patient and are to generate a hearing perception in the patient. The amplifier is generally integrated in the signal processing facility. Power is supplied to the hearing device by means of a battery integrated in the hearing device housing. The essential components of a hearing device are basically arranged on a printed circuit board as a circuit substrate and/or connected thereto.

Besides hearing devices, hearing instruments can also be embodied as so-called tinnitus maskers. Tinnitus maskers are used to treat tinnitus patients. They generate acoustic output signals dependent on the respective hearing impairment and, depending on the working principle, also on ambient noises, said output signals possibly contributing to reducing the perception of interfering tinnitus or other ear noises.

Furthermore, hearing instruments can also be embodied as telephones, cell phones, headsets, earphones, MP3 players or other electronic telecommunication or entertainment systems.

The term hearing instrument is to be understood below both as hearing devices such as hearing aids, and also tinnitus maskers, comparable such devices as well as electronic telecommunication and entertainment systems.

Hearing instruments, in particular hearing aids, are known in various basic types. With ITE hearing devices (ITE, in-the-ear), a housing containing all functional components including microphone and receiver is worn at least partially in the auditory canal. CIC hearing devices (CIC, completely-in-canal) are similar to ITE hearing devices, but are however worn entirely in the auditory canal. With BTE hearing devices (BTE, behind-the-ear), a housing with components such as battery and signal processing facility is worn behind the ear and a flexible sound tube, also referred to as tube, routes the acoustic output signals of a receiver from the housing to the auditory canal, where an earpiece on the tube is frequently provided to reliably position the tube end in the auditory canal. RIC-BTE hearing devices (RIC, receiver-in-canal, BTE, behind-the-ear) are similar to BTE hearing devices, but the receiver is nevertheless worn in the auditory canal and instead of a sound tube, a flexible receiver tube routes electrical signals, instead of acoustic signals, to the receiver, which is attached to the front of the receiver tube, in most instances in an earpiece used for reliably positioning within the auditory canal. RIC-BTE hearing devices are frequently used as so-called open-fit devices, in which the auditory canal remains open for the passage of sound and air in order to reduce the interfering occlusion effect.

Deep-Fit hearing devices (Deep-Auditory canal hearing devices) are similar to the CIC hearing devices. While CIC hearing devices are however generally worn in a further outer (distal) lying section of the outer auditory canal, deep-rit hearing devices are moved (proximally) further toward the eardrum and are worn at least partially in the inner-lying section of the outer auditory canal. The outer-lying section of the auditory canal is a canal lined with skin and connects the auricle to the eardrum. In the outer-lying section of the outer auditory canal, which adjoins the auricle directly, this channel is formed from elastic cartilage. The channel from the temporal bone is formed in the inner-lying section of the outer auditory canal and thus consists of bones. The passage of the auditory canal between sections of cartilage and bone is generally angled at a (second) bend and describes a different angle from person to person. In particular, the bony section of the auditory canal is relatively sensitive to pressure and touch. Deep-Fit hearing devices are worn at least partly in the sensitive bony section of the auditory canal. On being fed into the bony section of the auditory canal, they must also pass through the mentioned second bend, which may be difficult depending on the angle. Furthermore, small diameters and winding form of the auditory canal may hamper the advance movement further.

It is common to all hearing device types that the smallest possible housing or designs are sought in order to increase wearing comfort, if applicable to improve the implant ability and if applicable to reduce the visibility of the hearing device for cosmetic reasons. The miniaturization is obviously very important, particularly in CIC and Deep Fit hearing instruments.

Modern binaural hearing instruments exchange control data between the right and left hearing instrument by way of an inductive radio system. The required data rates increase significantly, if acoustic signals or audio logical algorithms (e.g. for beam forming, Side look etc. . . ) are to be exchanged. A higher data rate requires a greater bandwidth. The bandwidth is however one of the main determining factors with respect to the sensitivity of the antenna or the transmission by comparison with interference signals. In view of the high packing density in hearing instruments, the internal interference signal sources are the main problem which is additionally intensified when the bandwidth is increased. In simple terms, the bridgeable distance would shorten in the case of the same antenna and the same energy requirement due to the increase in bandwidth. However, the antenna could be configured more efficiency, this is however normally only achieved by an unwelcome enlargement of the antenna volume.

The antenna is typically disposed directly adjacent to the circuit board and the receiver. The circuit board with its electronic components arranged thereupon and the receiver emit magnetic and electric fields, which could significantly hamper the wireless transmission. In view of the high packing density and individual positioning of circuit boards, receiver and further components in the hearing instrument, a shielding of components is thus usual. The circuit board is to this end typically enclosed within a shielding box. The receiver is typically enclosed within a shielding film or designed in another manner so as to be magnetically sealed.

The orientation of the antenna toward the receiver and the circuit board is crucial to the performance of the transmission system. In the case of hearing instruments of smaller design (e.g. ITE, CIC, Deep Fit), the antenna is usually fastened to or in the faceplate. The alignment of the antenna may be different for different faceplates of such hearing instruments and is determined statistically from a number of ear geometries. The actual installation position and alignment of the antenna and deviations compared with calculated optical alignment (normal distribution maxima) also involve large losses compared with the theoretically possible data transmission.

U.S. Pat. No. 7,443,991 B2 describes an ITE hearing instrument, in which an improvement in the wireless binaural data transmission is achieved by means of a favorable positioning of the antenna. To this end, the antenna is fastened to the faceplate by means of a correspondingly embodied holding arm. The holding arm allows for a favorable installation position and orientation of the antenna.

FIG. 1 shows a schematic representation by way of example of a CIC hearing instrument according to the prior art. The hearing instrument 1 is inserted into a human auditory canal. The relevant outer auditory canal with an outer-lying section 10 and inner-lying section 11 is shown. The proximal section 10 of the outer auditory canal is the further inner-lying section bordering the eardrum 12. The course of the outer auditory canal has a first bend 13 and a narrower second bend 14.

The hearing instrument 1 is moved as far as the second bend 14. It has a housing 2, in the distal section of which are arranged a signal processing facility 3 and an antenna 4. The antenna 4 is used for the wireless binaural data transmission to a hearing instrument (not shown in the figure) arranged in the other auditory canal of the hearing instrument wearer. The antenna 4 is aligned approximately in the direction of the other hearing instrument (not shown).

A receiver 5 and a sound channel 6 for routing the output signals of the receiver 5 are also arranged in the housing 2. Further components are omitted for the sake of clarity, for instance a power supply, electrical connections and shielding to protect the antenna 4 from electromagnetic interference signals of the signal processing facility 3 and the receiver 5.

The housing 2 has a schematic distal section and a proximal section which merge with one another. This is indicated by a dashed line and the letters D (distal) and P (proximal).

Hearing instruments with a smaller structure (e.g. ITE, CIC, Deep Fit) were previously normally not set up for wireless broadband binaural data exchange, since the energy requirement of the data transmission would be disproportionately high in view of the interference signal problems.

SUMMARY OF THE INVENTION

It is accordingly an object of the invention to provide a binaural hearing instrument and earpiece for a hearing instrument which overcome the above-mentioned disadvantages of the heretofore-known devices of this general type and which provides for a wireless broadband binaural data transmission with high bandwidth and low resource requirement as well as small structural dimensions, which can be manufactured easily and in a cost-effective manner.

With the foregoing and other objects in view there is provided, in accordance with the invention, a hearing instrument, comprising:

a housing configured for partial or complete insertion into a human auditory canal of a user, said housing having a distal section and a proximal section, said proximal section being spatially separated from said distal section and configured for placement adjacent the eardrum bounding the auditory canal inwardly;

a signal processing facility and a receiver disposed in said distal section of said housing;

an antenna disposed in said proximal section of said housing;

said proximal section of said housing having a diameter and a contour for enabling said proximal section to be positioned in a region of a second bend or deeper in the human auditory canal; and wherein a shape of said proximal section and an arrangement of said antenna in said proximal section are adapted to the auditory canal to assure that, when said proximal section is inserted in the auditory canal, said antenna is aligned with a respectively opposite auditory canal of the user wearing the hearing instrument. Here, the term "aligned" means that the antenna is functionally aimed at or towards the opposite auditory canal (so as to minimize the functional distance between the antennas of the two binaural devices).

A basic concept of the invention provides for a hearing instrument including a housing, a signal processing facility, a receiver and an antenna for binaural data transmission. The housing is configured such that it can be worn at least partly in an auditory canal. It has a distal section, in which are arranged the signal processing facility and receiver, and a proximal section adjacent to the eardrum and separated spatially there from, in which the antenna is arranged.

The antenna is disposed between the receiver and the sound outlet, consequently as far as possible proximally in the auditory canal. As a result, the distance between the antennas of the two binaural hearing instruments is reduced by at least 1-2 cm compared with the conventional positioning. With a high data rate (greater bandwidth), each reduction, however small, in the distance (for instance 1-2 cm) results in a significant improvement in the BER (Bit Error Rate). A reduction in the distance can in turn permit a reduction in the efficiency or the volume of the antenna. It is apparent that the influences of the distance and efficiency of the antennas with respect to the possible transmission bandwidth are mutually dependent.

The invention advantageously ensures a defined minimum distance between the antenna and the receiver and the hybrid, as a result of which electromagnetic interference effects on the antenna are reduced to a minimum from the outset. Furthermore, the interference effect is as a result extremely stable and can thus be calculated. In addition, it remains to the greatest extent independent of different signal processing algorithms on the circuit board (each configuration or firmware has a different interference potential and interference characteristic). Neither do shielding films or shielding boxes need to be installed.

An advantageous development of the basic idea consists in the antenna having a feed through with a distal and a proximal opening, which is embodied as a sound canal, and in the distal opening being connected to an output of the receiver.

The antenna has a continuous opening, which is used as a sound channel. With a view to simplifying design engineering, the opening is advantageously disposed in the center of the antenna. If, in a conventional embodiment, the antenna surrounds a ferrite core or a ferrite sleeve or ferrite material, the opening can be surrounded in a structurally simple manner by ferrite. The combination of antennas and sound channel allows for a particularly uncomplicated and space-saving arrangement. It is particularly advantageous here if the antenna, ferrite and opening are embodied in an integrated manner with particularly small structural dimensions. In such cases, practice has shown that the opening through the ferrite material only brings about minimal losses in performance. This arrangement of antenna, ferrite and opening thus allows for a particularly small installation size with at the same time a particularly high performance.

A further advantageous development of the basic idea consists in the distal and proximal section together forming an ITE housing to be worn in the auditory canal.

A further advantageous development of the basic idea consists in the distal and proximal section being embodied separately and being connected to one another by means of an electrical and acoustic conductor.

A further advantageous development of the basic idea consists in the proximal section including a flexible dome or an expandable element, by means of which the proximal section can be positioned in the auditory canal.

A further advantageous development of the basic idea consists in the diameter and contour of the proximal section being configured such that the proximal section can be positioned in the region of the second bend or lower (further proximally) in a human auditory canal.

This type of antenna and its positioning allows for hearing instruments of a smaller design to be worn in the auditory canal, in particular ITE, Deep Fit and CIC, to be binaurally coupled to a high audio band width. In the process, a low energy requirement, lower costs and a high and stable transmission system quality are ensured at the same time.

In order to compensate for a possible increase in the antenna volume, the antenna is configured such that it uses a volume in the hearing instrument that would otherwise remain unused. To this end, the antenna is arranged in a volume in the hearing instrument which cannot be used for other components, for instance the receiver, namely deep inside the auditory canal. The volume at and after the second bend in the auditory canal normally remains unused, since a receiver is too long for instance, to pass around the second bend or to be accommodated therein. The antenna can however be embodied in shorter form. It is therefore possible to position the same in the region of the second bend or lower in the auditory canal in order to use this volume. The enlarged antenna volume of an efficiently configured antenna can be at least partly compensated for by using an otherwise unusable volume.

A further advantageous development of the basic idea consists in the shape of the proximal section and the arrangement of the antenna in the proximal section being adjusted to the auditory canal such that the antenna of the hearing instrument inserted into the auditory canal is aligned toward the respective other auditory canal of a wearer of the hearing instrument.

The orientation (alignment) of the antennas has a great influence on the possible transmission bandwidth between binaurally coupled hearing instruments. The antenna is aligned in the direction of the bony area and is disposed in the hearing instrument inserted as intended into the auditory canal at the second bend or deeper in the auditory canal, so that a part of or the entire antenna volume is disposed in the bony area of the auditory canal. The positioning of the antenna depends on the shape and/or the volume available at the second bend in the auditory canal. The positioning is defined in rapid shell manufacturing software such that a simple insertion and removal of the hearing instrument is enabled to the hearing instrument wearer. This is enabled by a deep impression of the auditory canal, which includes the spatial information relating to the direction of the bony area.

Finally the design of the second bend and the bony section of the auditory canal thus ensure a stable alignment of the antenna. The alignment of the two binaural antennas achieved in this way is almost optimal on account of the nature of the human auditory canal. The transmission system with very small angular losses can therefore be calculated and hardly any fluctuations occur on account of individual different ear geometries.

With the above and other objects in view there is also provided, in accordance with the invention, an earpiece for a hearing instrument, comprising:

a positioning element in the form of a flexible dome or an expandable element for positioning the earpiece in the auditory canal of a user;

an antenna for binaural data transmission formed with a feed-through having a distal opening and a proximal opening and forming a sound channel;

said distal opening being configured for a functional connection to an output of a receiver of the hearing instrument; and wherein a shape of the earpiece and an arrangement of said antenna in the earpiece are adjusted to the auditory canal such that said antenna of the earpiece inserted into the auditory canal is aligned toward a respectively opposite auditory canal of the user wearing the earpiece.

It is advantageous if a diameter (i.e., dimensions) and a contour of the earpiece are configured to enable its positioning in a region of the second bend or deeper in the human auditory canal.

A further basic idea of the invention consists in an earpiece for a hearing instrument, which includes a flexible dome or an expandable element, by means of which it can be positioned in the auditory canal. An antenna for binaural data transmission is arranged in the earpiece, which has a feed through with a distal and a proximal opening, which is embodied as a sound channel. The distal opening is embodied so as to be connected to an output of a receiver.

The antenna is disposed between the receiver and the sound outlet, consequently as far as possible proximally in the auditory canal. As a result, the distance between the antennas of the two binaural hearing instruments is reduced by at least 1-2 cm compared with the conventional positioning. With a high data rate (greater bandwidth), each reduction, however small, in the distance (for instance 1-2 cm) results in a significant improvement in the BER (Bit Error Rate). A reduction in the distance can in turn permit a reduction in the efficiency or the volume of the antenna. It is apparent that the influences of the distance and efficiency of the antennas with respect to the possible transmission bandwidth are mutually interdependent.

The antenna core has a continuous hole, which is used as a sound channel. With a view to simplifying design engineering, the hole is advantageously disposed in the center of the ferrite core, but can however deviate there from. The combination of antennas and sound channel allows for a particularly uncomplicated and space-saving arrangement.

The invention advantageously ensures a defined minimum dis-tance between the antenna and the receiver and the hybrid, as a result of which electromagnetic interference effects on the antenna are reduced to a minimum from the outset. Furthermore, the interference effect is as a result extremely stable and can thus be calculated. In addition, it remains to the greatest extent independent of different signal processing algorithms on the circuit board (each configuration or firmware has a different interference potential and interference characteristic). Neither do shielding films or shielding boxes need to be installed.

An advantageous development of the basic idea consists in the diameter and contour of earpiece being configured such that it can be positioned in the region of the second bend or deeper in a human auditory canal.

This type of antenna and its positioning allows for hearing instruments of smaller designs to be worn in the auditory canal, in particular ITE, Deep Fit and CIC, to be binaurally coupled at a high audio bandwidth. In such cases, a low energy requirement, lower costs and a high and stable transmission system quality are ensured at the same time.

In order to compensate for a possible increase in the antenna volume, the antenna is configured such that it uses a volume in the hearing instrument that would otherwise remain unused. To this end, the antenna is arranged in a volume in the hearing instrument, which cannot be used for other components, for instance the receiver, namely deep inside the auditory canal. The volume at and proximal to the second bend in the auditory canal normally remains unused, since a receiver is too long for instance in order to pass through the second bend or to be accommodated therein. The antenna can however be embodied in shorter form. It is therefore possible to position the same in the region of the second bend or deeper in the auditory canal in order to use this volume. The enlarged antenna volume of an efficiently configured antenna can be at least partly compensated for by using an otherwise unusable volume.

A further advantageous development of the basic idea consists in the shape of the earpiece and the arrangement of the antenna in the earpiece being adjusted to the auditory canal such that the antenna of the earpiece inserted into the auditory canal is aligned toward the respective other auditory canal of a wearer of the earpiece.

The orientation (alignment) of the antennas has a huge influence on the possible transmission bandwidth between binaurally coupled hearing instruments. The antenna is aligned in accordance with the direction of the bony area and is disposed in the case of a hearing instrument inserted as intended into the auditory canal in the area of the second bend or deeper in the auditory canal so that part of or the entire antenna volume is disposed in the bony area of the auditory canal. The positioning of the antenna depends on the shape and/or the volume available at the second bend of the auditory canal and proximally thereof. The positioning is defined in rapid shell manufacturing software such that a simple insertion and removal of the hearing instrument is enabled to the hearing instrument wearer. This is enabled by a deep impression of the auditory canal, which includes the spatial information of the direction of the bony area.

Finally the nature of the second bend and the bony section of the auditory canal thus ensure a stable alignment of the antenna. The alignment of the two binaural antennas relative to one another achieved in this way is almost optimal on account of the shape of the human auditory canal. The transmission system can therefore be calculated with very small angular losses and hardly any fluctuations occur on account of individual different ear geometries.

The invention enables a cost-saving construction, since no or few shielding measures are required, no special, magnetically sealed receivers are required and since a simpler production of the hearing instrument is enabled, because no special influence need be taken into consideration in the positioning of the antennas and no special knowledge is required for its assembly.

In addition, it is significantly easier to position two "angular" components (circuit board and receiver) individually in the individually predetermined form of a hearing instrument than three "angular" components (circuit board, receiver and antenna), particularly since larger non-usable volumes develop in the case of three components.

Other features which are considered as characteristic for the invention are set forth in the appended claims.

Although the invention is illustrated and described herein as embodied in a binaural hearing instrument and earpiece, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
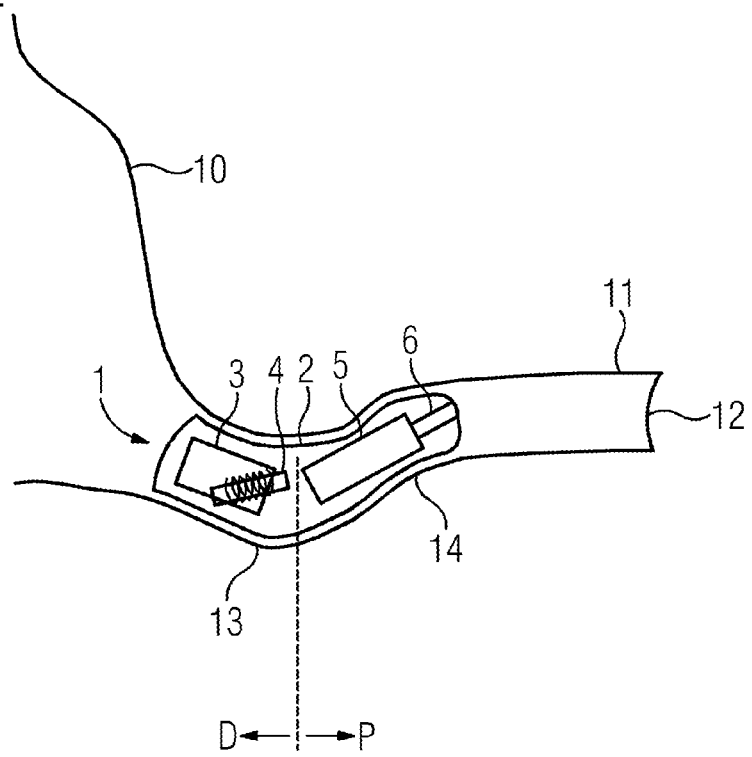
FIG 1 PRIOR ART
FIG. 1 is a diagrammatic view of an earpiece for a hearing instrument according to the prior art.
Figure 2:
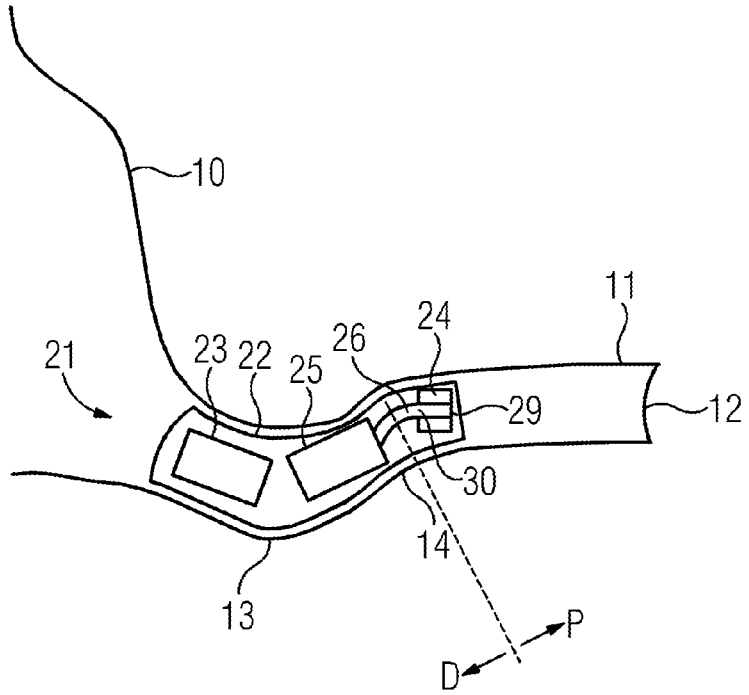
FIG. 2 is a similar view showing a CIC instrument with a proximal antenna.

Referring now to the figures of the drawing in detail and first, particularly, to FIG. 2 thereof, there is shown a schematic representation of a CIC hearing instrument with a proximal antenna according to the invention. The hearing instrument 21 is inserted into a human auditory canal. As explained above, the relevant outer auditory canal is shown with a distal section 10 and a proximal section 11. The course of the outer auditory canal has a first bend 13 and a narrower second bend 14.

The hearing instrument 21 is fed into the area of the second bend 14 of the auditory canal. It has a housing 22, in the distal section of which are arranged a signal processing facility 23, or signal processing unit SPU, and a receiver 25. The receiver 25 is connected on the output side to a sound channel 26. The channel 26 routes the output signals of the receiver 25 in the direction towards the eardrum 12. Further components, for instance a power supply and electrical lines, are left out for the sake of clarity.

An antenna 24 is arranged proximal to the receiver 25. The positioning of the antenna 24 in the housing distal to the receiver 25 is thus omitted so that there is more flexibility for the arrangement of the signal processing facility 23, receiver 25 and further components (not shown). In addition, the housing can be embodied to be smaller distally from the receiver 25, which is apparent in the image, such that compared with the prior art shown above, it has a smaller distal extension, i.e. reaches less far toward the ear.

The antenna 24 is used for the binaural data transmission to a paired hearing instrument that is arranged in the other auditory canal of the hearing instrument wearer. The antenna 24 has a distal opening 30, from which a feed through leads to a proximal opening 29. The feed through from the distal 30 to the proximal opening 29 forms a sound channel. The feed through is thus an integral part of the sound channel 26 and is used to route output signals (i.e., sound waves) from the receiver 25 through the antenna 24.

The antenna 24 is arranged in the region of the second bend 14 or proximally thereto in the outer auditory canal. It is shown schematically that the shape of the housing 22 in this region is adjusted to the shape of the auditory canal and/or the course of the second bend 14 in the auditory canal. It is apparent that on account of the proportionately narrow second bend 14 in this area, no long and large components can be arranged, since these cannot pass through the second bend 14. The antenna 24 can however be designed sufficiently short to have enough space here.

The exact adjustment of the housing 22 to the area of the second bend 14 produces a spatially stable positioning and orientation of the housing 22 with respect to the second bend 14 or the bony part of the auditory canal. A stable positioning and orientation of the antenna 24 arranged in the housing 22 is produced as a result. In such cases, the antenna 24 is either mounted on the housing 22 or on the receiver tube forming the sound channel 26. The assembly on the receiver tube in such cases allows for simpler installation in the housing 22, because only the receiver tube pre-assembled with the antenna 24 needs to be introduced into the housing 22. When assembling the antenna 24 on the housing 22, both the antenna 24 and also the receiver tube must instead be mounted in the housing 22, which, in view of the narrow space available, is comparatively more expensive. The antenna 24 could be inserted, for instance, through a proximal opening into the housing 22 (not illustrated in the figure).

It is apparent that the antenna 24 is positioned closer to the eardrum 12 and thus closer to the opposite ear or hearing instrument than any other element of the hearing instrument 21. This results in a smaller distance from the eardrum 12 compared with the conventional positioning of an antenna, wherein the reduction in the distance can lie in an order of magnitude of one to two centimeters. This reduction in the distance from the opposite ear or hearing instrument significantly benefits the quality of the binaural data transmission, in particular the bandwidth.

In addition, the antenna 24 in the housing 22 is positioned spatially separate from the further components arranged therein, wherein the spatial separation lies in the region of the dashed line. A minimum distance between the antenna 24 and the further electrical components can be ensured by means of this arrangement, which brings about a reduction in the electrical and magnetic interference effects of the components on the antenna 24. This positioning of the antenna 24 likewise brings about an improvement in the quality of the binaural transmission system. In addition, it is as a result possible to dispense with or reduce additional shielding measures for shielding the antenna 24 from interference effects from the further electrical components.

Figure 3:
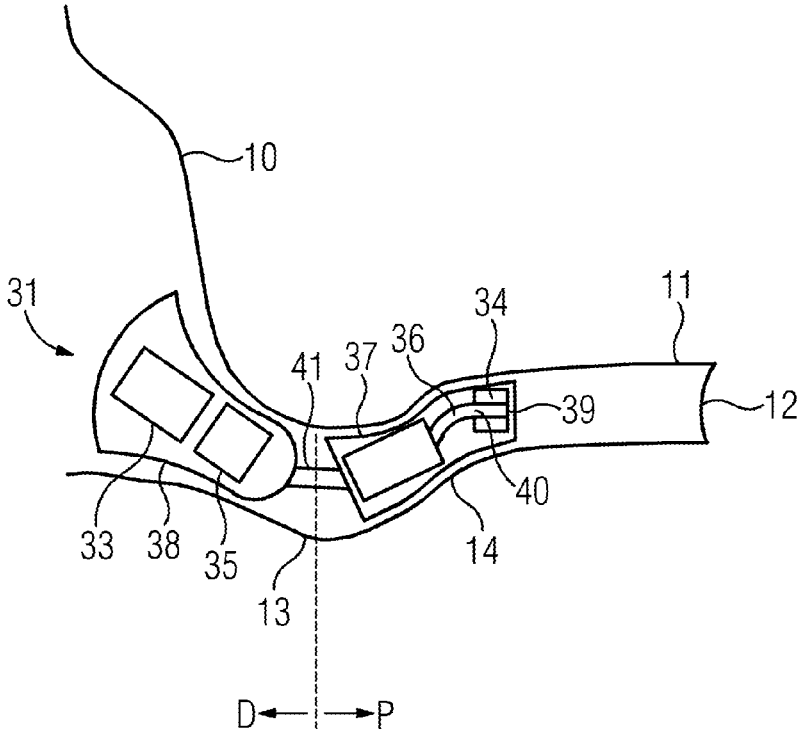
FIG. 3 shows a two-part hearing instrument with a proximal antenna.

FIG. 3 shows a schematic representation of a variant of a hearing instrument with a two-part housing and proximal antenna 14. The hearing instrument 31 has a distal housing section 38, in which a signal processing facility (SPU) 33 and a receiver 35 are arranged. As mentioned above, the representation of further components was dispensed with for the sake of clarity.

The distal housing section 38 is connected to a proximal housing section 37 by way of an electric and acoustic line 41. In the region of the proximal housing section 14, in other words in the region of the second bend 14 in the outer auditory canal, there is significantly less space available. Therefore only a minimum number of electrical components of the hearing instrument 31 are arranged in the proximal housing section 37 positioned here. This is essentially only the antenna 34 and the electrical supply line for actuating the antenna 34. The antenna 34 has a feed through with a distal opening 40 and proximal opening 39, through which a sound channel 36 runs. The sound channel 36 is used together with the line 41, to route output signals from the receiver 35 through the antenna 34 to the eardrum 12.

The two-part housing variant shown is used to significantly increase the distance between the antenna 34 and the further electrical components, which are essentially arranged in the distal housing section 38. As a result, electric and magnetic interference effects of the further components on the antenna 34 are reduced to a minimum.

Furthermore, the antenna 34 is arranged as close as possible to the eardrum 12 and thus also to the opposite hearing instrument of a binaural hearing system (not shown in the figure). The shortening of the distance between the two hearing instruments of the binaural hearing system benefits the bandwidth of the binaural transmission system.

Figure 4:
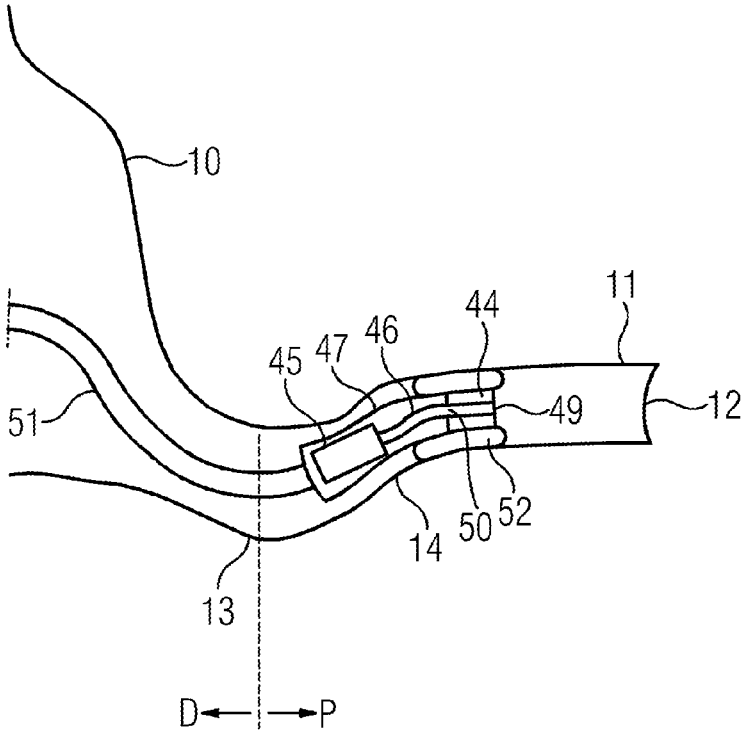
FIG. 4 shows an earpiece with a balloon.

FIG. 4 shows a schematic representation of an earpiece with a balloon and a proximal antenna. An electrical line 51 is used to actuate a receiver 45 arranged in the earpiece 47 and the antenna 44 arranged in the earpiece 47. The antenna 44 is positioned proximally to the receiver 45 in the region of the second bend 14 or deeper in the outer auditory canal. It is arranged in the earpiece 47 with a spatial separation from the receiver 45. Output signals of the receiver 45 are routed through a sound channel 47 through the antenna 44 to the eardrum 12. To this end, the antenna 44 has a feed through with a distal opening 50 and a proximal opening 49, with which the receiver 45 is connected through the sound channel 46.

A positioning element, such as a balloon 52 that can be inflated according to requirements allows to position the earpiece 47 in the auditory canal. Upon insertion or removal of the earpiece 47 in or from the auditory canal, the balloon 52 can by contrast be compressed or deflated. A pump mechanism, which is not shown in the figures for the sake of clarity, is provided for inflation and deflation. The earpiece 47 shown can be used for instance in a two-part housing as mentioned above or in a BTE hearing instrument.

Figure 5:
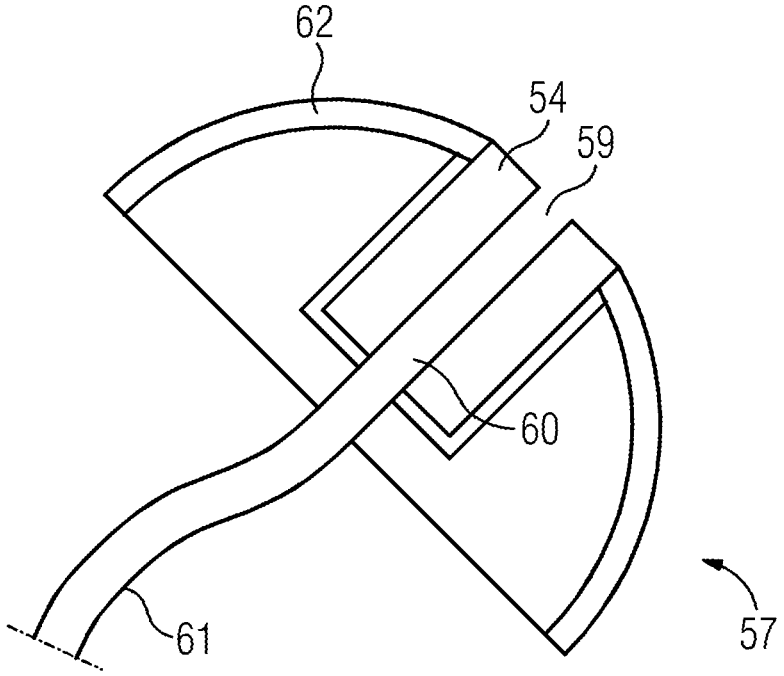
FIG. 5 shows an earpiece with a dome.

FIG. 5 shows a schematic representation of an earpiece 57. An electric and acoustic line 61 is used to supply acoustic signals, which are generated by a receiver (not shown), and to supply control signals for an antenna 54. Acoustic signals are routed through a distal opening 60 and a feed through through the antenna to its proximal opening 59 and thus reach the eardrum of an auditory canal (not shown), into which the earpiece 57 can be inserted. Here, the earpiece 57 has a positioning element in the form of a flexible dome 62, by means of which it can be positioned in an auditory canal. In this way the antenna 54 can be positioned at a significant distance from further electrical components of a hearing instrument, for instance a BTE hearing instrument, and as far as proximally possible in the auditory canal.

Once more in summary: The invention relates to a binaural hearing instrument and to an earpiece for a binaural hearing instrument, which allows for a broadband wireless data transmission to a further binaural hearing instrument. The object underlying the invention consists in specifying a hearing instrument and an earpiece for a hearing instrument, which are to specify a wireless broadband binaural data transmission with high bandwidth and low resource requirement, which can be manufactured easily and in a cost-effective manner. A basic idea of the invention consists in a hearing instrument including a housing, a signal processing facility, a receiver and an antenna for binaural data transmission. The housing is configured such that it can be worn at least partly in an auditory canal. It has a distal section, in which are arranged the signal processing facility and receiver, and a proximal section adjacent to the eardrum and separated spatially there from, in which the antenna is ar-ranged. The antenna is disposed between the receiver and the sound outlet, consequently as far as proximally possible in the auditory canal. As a result, the distance between the antennas of the two binaural hearing instruments is reduced by at least 1-2 cm compared with the conventional positioning. With a high data rate (greater bandwidth), each reduction, however small, in the distance (for instance 1-2 cm) results in a significant improvement in the BER (Bit Error Rate). The invention advantageously ensures a defined minimum distance between the antenna and the receiver and the hybrid, as a result of which electromagnetic interference effects on the antenna are reduced to a minimum from the outset.

The invention claimed is:

1. A hearing instrument, comprising:

a housing configured for partial or complete insertion into a human auditory canal of a user, said housing having a distal section and a proximal section formed as separate units, said proximal section being spatially separated from said distal section and configured for placement adjacent the eardrum;

a signal processing facility and a receiver disposed in said distal section of said housing;

an antenna disposed in said proximal section of said housing;

an electrical conductor for actuating said antenna, said electrical conductor interconnecting said distal section and said proximal section;

said proximal section of said housing having a diameter and a contour for enabling said proximal section to be positioned in a region of a second bend or deeper in the human auditory canal;

a sound tube connecting said distal section to said proximal section for conducting sound from said distal section, through said proximal section and to the eardrum, said sound tube carrying said antenna and projecting through said antenna; and said sound tube and said electrical conductor forming a connection between said distal section and proximal section to enable said housing to adjust to a shape of the auditory canal and the second bend formed in the auditory canal, and wherein a shape of said proximal section and an arrangement of said antenna in said proximal section are adapted to the auditory canal to assure that, when said proximal section is inserted in the auditory canal, said antenna is aligned with a respectively opposite auditory canal of the user wearing the hearing instrument.

2. The hearing instrument according to claim 1, wherein said antenna is formed with a feed-through having a distal opening and a proximal opening and defining a sound channel, and wherein said distal opening of said feed-through is connected through said sound tube to an output of said receiver.

3. The hearing instrument according to claim 1, wherein said distal and proximal sections together form an in-the-ear housing to be worn in the auditory canal.

4. The hearing instrument according to claim 1, wherein said proximal section includes a flexible dome or an expandable element for fixedly positioning said proximal section in the auditory canal.

* * * * *